US008269088B1

(12) United States Patent
Liao

(10) Patent No.: US 8,269,088 B1
(45) Date of Patent: Sep. 18, 2012

(54) CYMBAL SUPPORT STRUCTURE

(76) Inventor: Tsun-Chi Liao, Taichung (TW)

( * ) Notice: Subject to any disclaimer, the term of this patent is extended or adjusted under 35 U.S.C. 154(b) by 44 days.

(21) Appl. No.: 13/047,572

(22) Filed: Mar. 14, 2011

(51) Int. Cl.
*G10D 13/02* (2006.01)

(52) U.S. Cl. ..... 84/421; 84/422.1

(58) Field of Classification Search ..... 84/422.1, 84/422.2, 422.3
See application file for complete search history.

(56) References Cited

U.S. PATENT DOCUMENTS 6,054,645 A * 4/2000 Gauger ..... 84/422.3

* cited by examiner

*Primary Examiner* — Kimberly Lockett
(74) *Attorney, Agent, or Firm* — Muncy, Geissler, Olds & Lowe, PLLC

(57) ABSTRACT

A cymbal support structure for holding a cymbal comprises a rod, a nut, a rotary element, an upper felt, a lower felt, a compression element, and an elevation adjustment ring. The nut is fastened to one end of the rod. The rotary element is pivotally coupled to the nut. The upper and lower felts clamp the cymbal. When the rotary element is rotated to parallel the nut, the cymbal and the upper and lower felts pass through the nut and rotary element to couple on the rod. When the rotary element is rotated to not parallel the nut, the cymbal and the upper and lower felts are prevented from passing through the rod. The elevation adjustment ring is screwed on the rod to push the compression element to compress the lower felt upwards. Via rotating the rotary element, the user can easily assemble or disassemble the cymbal to perform replacement.

8 Claims, 7 Drawing Sheets

CYMBAL SUPPORT STRUCTURE

FIELD OF THE INVENTION

The present invention relates to a cymbal support structure, particularly to a cymbal support structure for holding a cymbal which can be assembled and disassembled rapidly.

BACKGROUND OF THE INVENTION

Refer to FIG. 1. The conventional cymbal support structure comprises a stand 5, a rod 1 installed on the stand 5, two damping felts 2 penetrated by the top of the rod 1, a cymbal 3 clamped by the two felts 2, and a screw nut 4 screwed into the rod 1 to secure the two felts 2, whereby the cymbal 3 is held by the upper and lower felts 2.

The user may percuss the cymbal 3 installed on the abovementioned support structure to generate sounds. However, the cymbal 3 is disassembled after the screw nut 4 has been dismounted 3. Therefore, replacing the cymbal 3 is laborious and time-consuming. Further, the screw nut 4 is likely to be worn and loosened after it has been mounted and dismounted repeatedly. Thus, the screw nut 4 cannot fasten the felts 2 securely, and the cymbal 3 may be easily loosened during percussion to alter the timbre thereof.

SUMMARY OF THE INVENTION

The primary objective of the present invention is to provide a cymbal support structure, whereby the user can easily and rapidly to replace the cymbal.

To achieve the abovementioned objective, the present invention proposes a cymbal support structure for holding a cymbal. The cymbal support structure comprises a rod, a nut, a rotary element, an upper felt, a lower felt, a compression element, and an elevation adjustment ring. The rotary element and the nut are respectively formed in an elongate shape. The nut is fastened to one end of the rod. The rotary element is pivotally coupled to the nut. The upper and lower felts clamp the cymbal. When the rotary element is rotated to parallel the nut, the cymbal, the upper felt and the lower felt can pass through the nut and the rotary element to couple on the rod. When the rotary element is rotated to not parallel the nut, the cymbal, the upper felt and the lower felt can be prevented from passing through the rod. The compression element is coupled on the rod. The elevation adjustment ring is screwed on the rod to push the compression element to compress the lower felt upwards.

In the present invention, the user can easily rotate the rotary element to assemble and disassemble the cymbal to rapidly replace the cymbal. Further, the rotary element also can effectively secure the cymbal without being loosened during percussion. Furthermore, the elevation adjustment ring can be moved along the rod to adjust the height thereof and alter the compression degree of the compression element, whereby the cymbal can generate different resonant sounds to meet user's requirements.

DETAILED DESCRIPTION OF THE PREFERRED EMBODIMENTS

Below, the embodiments are described in detail in cooperation with the drawings to demonstrate the technical contents, characteristics and efficacies of the present invention.

Figure 1:
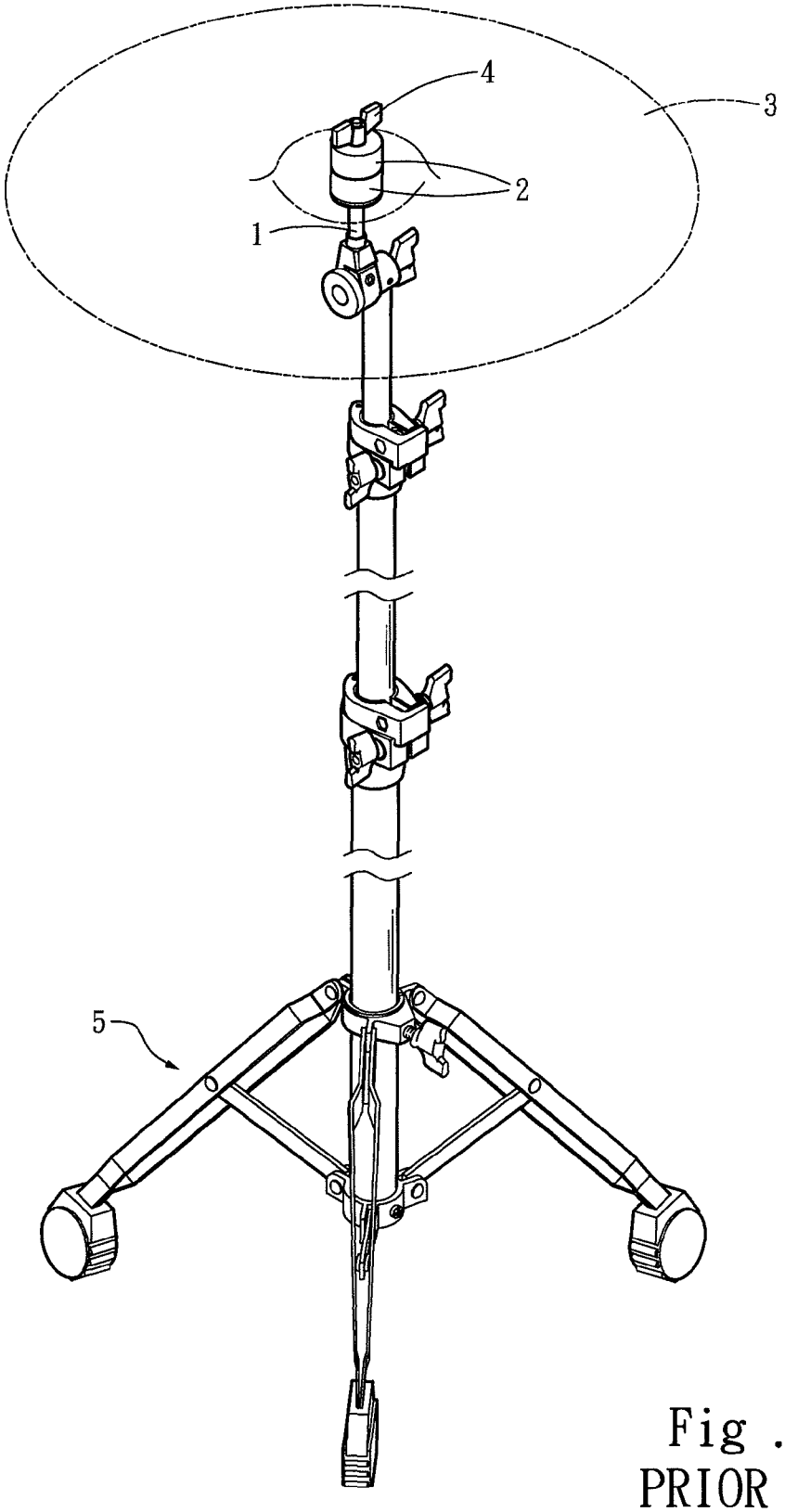
Fig. 1 PRIOR ART
FIG. 1 is a perspective view showing a conventional cymbal support structure.
Figure 2:
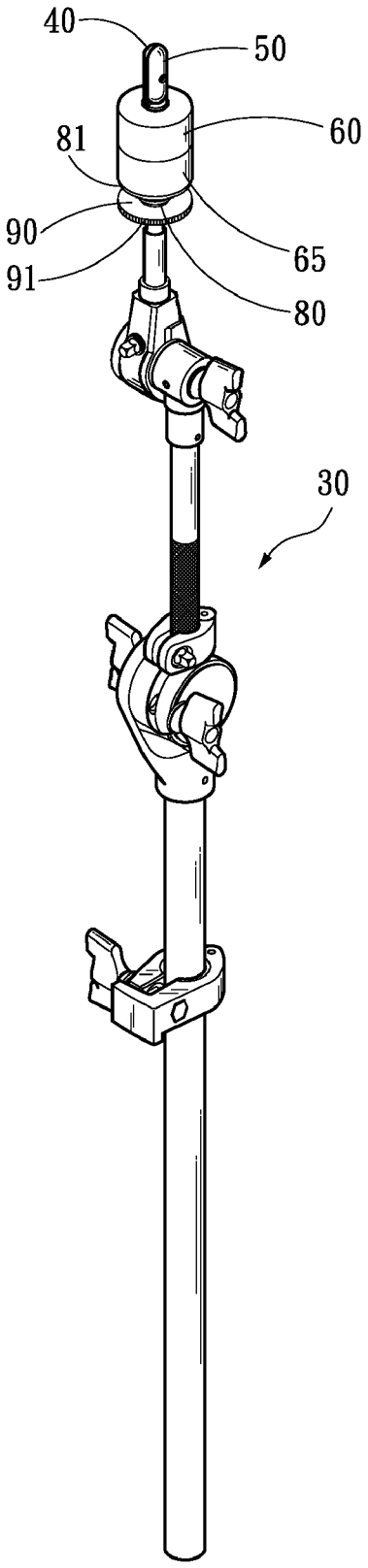
FIG. 2 is a perspective view showing a cymbal support structure according to one embodiment of the present invention in an assembled condition.
Figure 3:
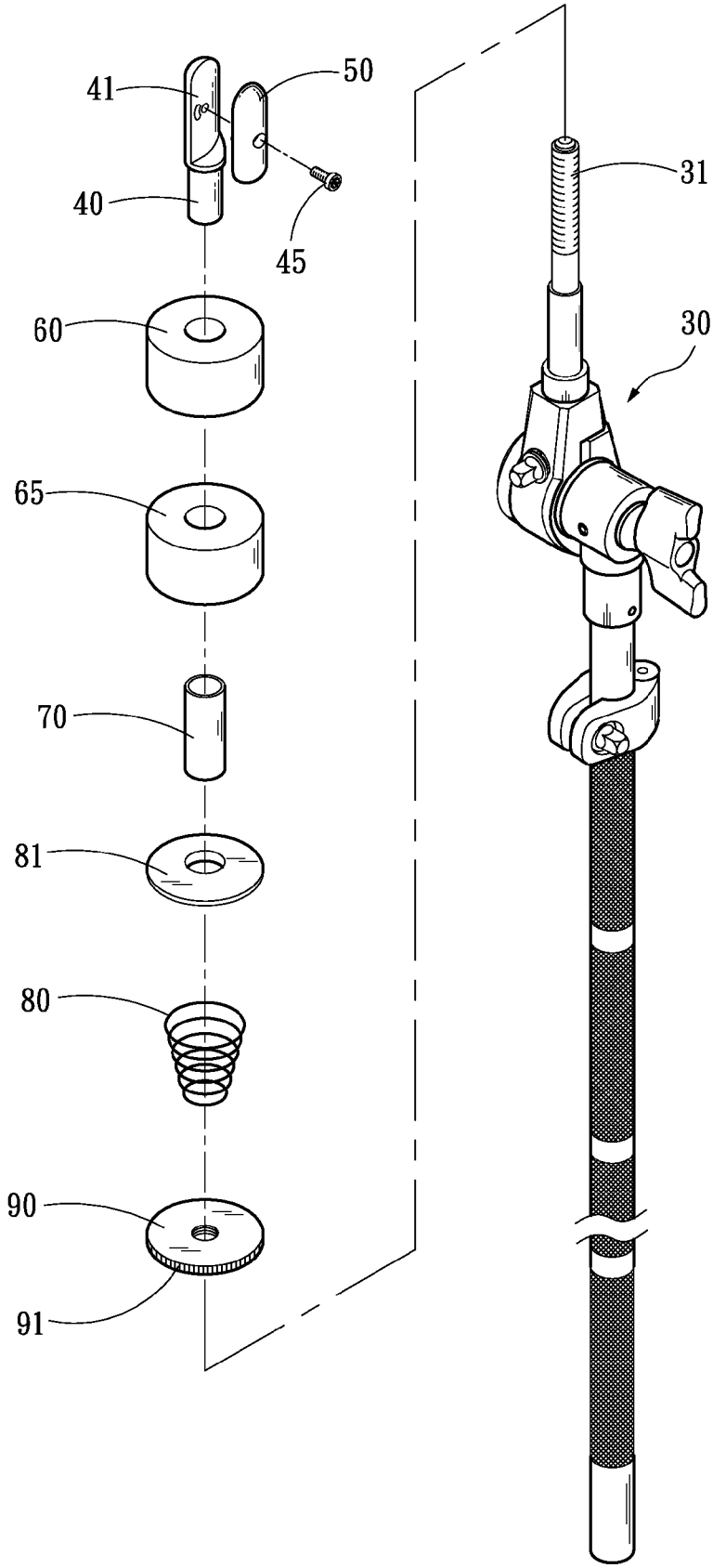
FIG. 3 is an exploded view showing a cymbal support structure according to one embodiment of the present invention.
Figure 4:
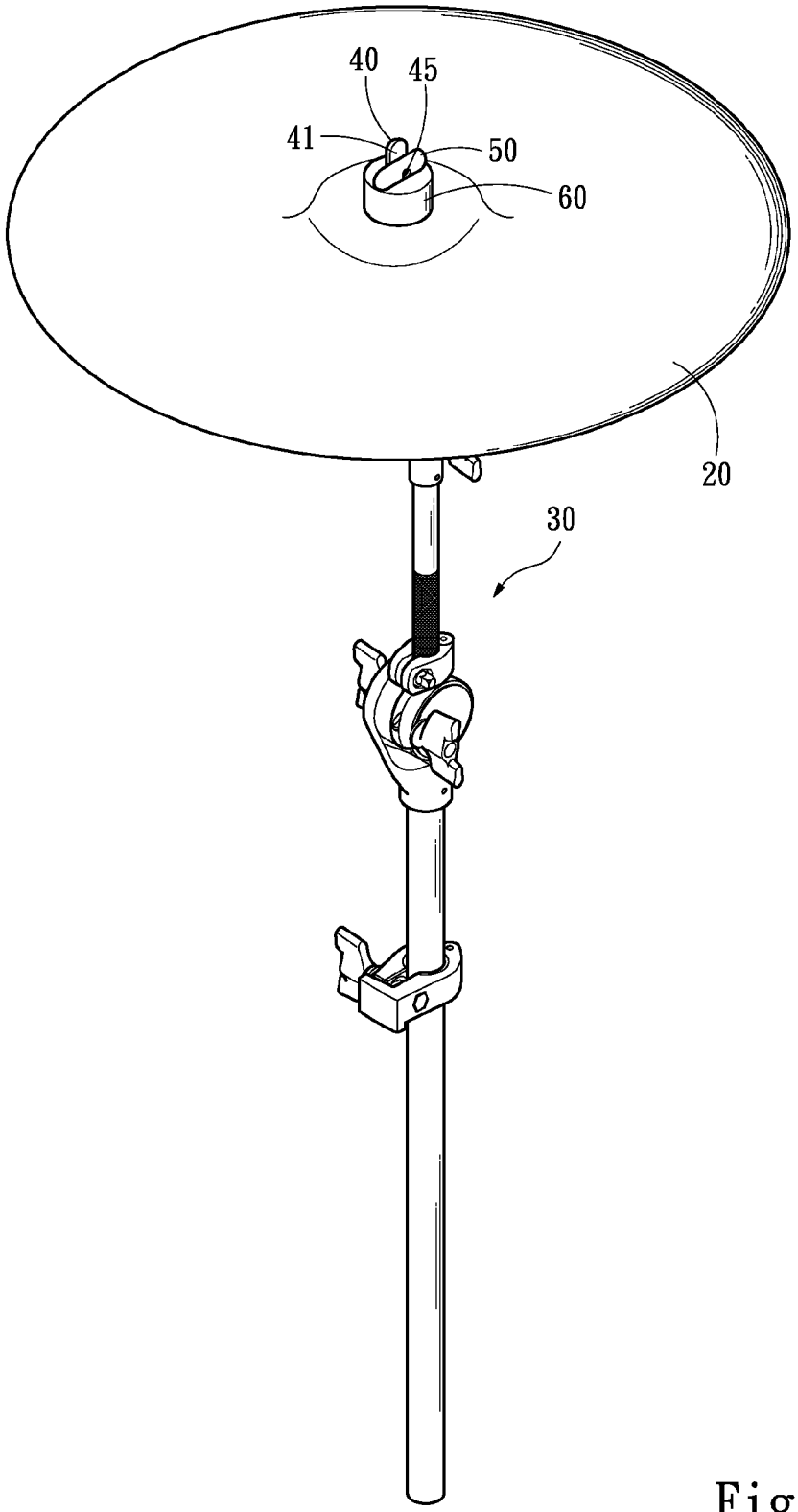
FIG. 4 is a schematic view showing a cymbal is clamped according to one embodiment of the present invention.

Refer to FIG. 2, FIG. 3 and FIG. 4. The present invention proposes a cymbal support structure for holding a cymbal 20. The cymbal support structure comprises a rod 30, a nut 40, a rotary element 50, a screw 45, an upper felt 60, a lower felt 65, a plastic sleeve 70, a compression element 80, and an elevation adjustment ring 90. The rotary element 50 and the nut 40 are respectively formed in an elongate shape. The nut 40 is fastened to one end of the rod 30. The rod 30 has threads 31, and the nut 40 is screwed on a distal end of the threads 31.

The screw 45 is inserted into the middle portion of the rotary element 50 and screwed onto the nut 40. Thereby, the rotary element 50 is pivotally coupled to the nut 40. The nut 40 has a notch 41 where the rotary element 50 is pivotally coupled to. When the rotary element 50 is rotated to parallel the nut 40, the cymbal 20 can pass through the nut 40 to couple on the rod 30. When the rotary element 50 is rotated to not parallel the nut 40, the cymbal 20 is prevented from passing through the rod 30.

When the rotary element 50 is rotated to parallel the nut 40, the upper felt 60 and the lower felt 65 are coupled on the rod 30 to clamp the cymbal 20 therebetween. The plastic sleeve 70 is coupled on the rod 30 and installed below the lower felt 65 to elevate and isolate the cymbal 20 to prevent collision of metals lest noise is generated.

The compression element 80 is coupled on the rod 30. The elevation adjustment ring 90 is screwed on the threads 31 to push the compression element 80 to compress the lower felt 65. The compression element 80 may be a spring. The elevation adjustment ring 90 has anti-slipping traces 91 on the circumference to facilitate adjusting the position of the elevation adjustment ring 90 by the user to change the compression degree of the compression element 80, i.e. alter the force of compressing the lower felt 65. Thus, the cymbal 20 can generate different resonant sounds. Besides, a washer 81 may be arranged between the compression element 80 and the lower felt 65 to supply uniform applying force to the lower felt 65.

Figure 5A:
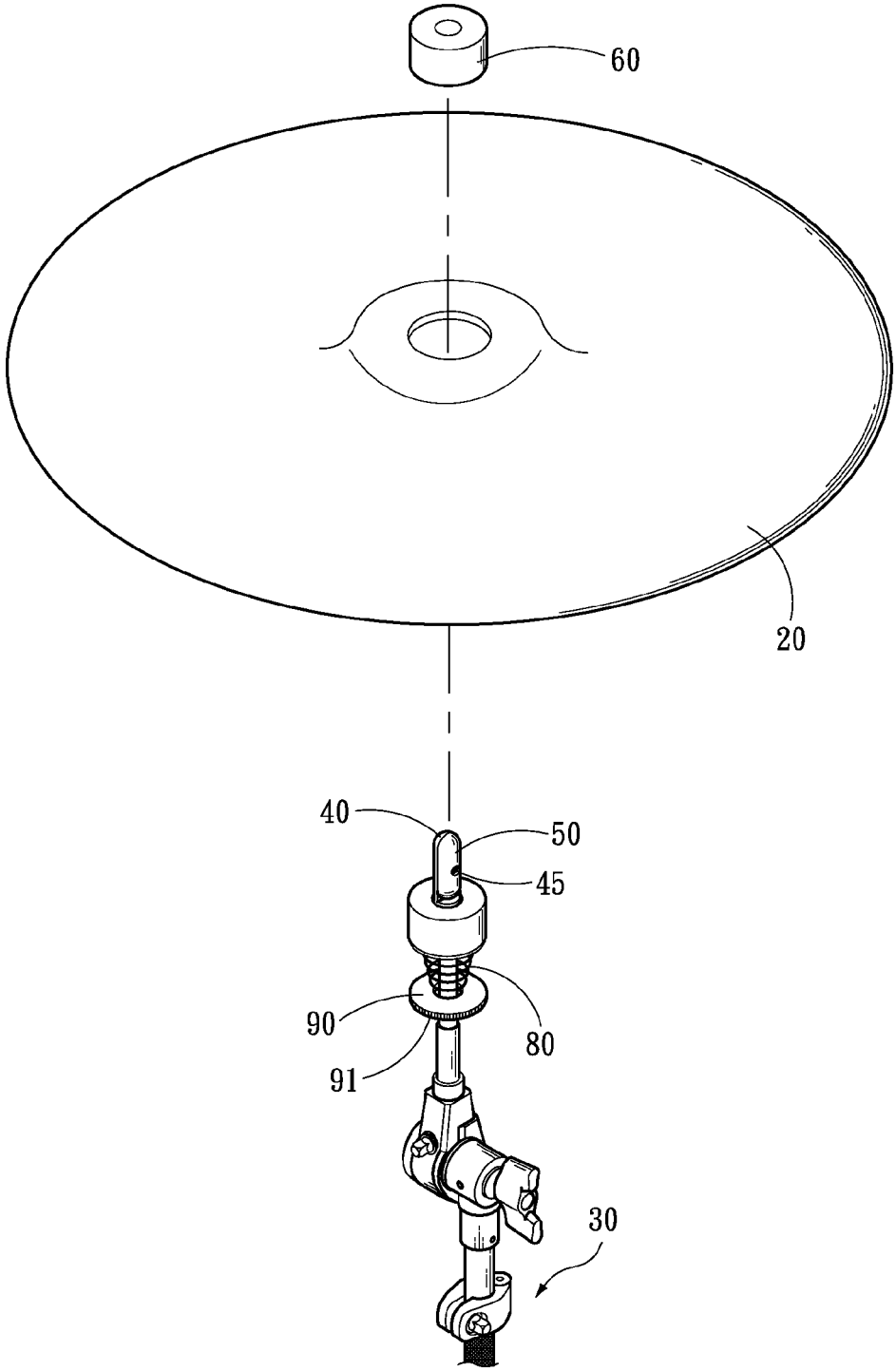
FIG. 5A is a schematic view showing a cymbal is assembled according to one embodiment of the present invention.
Figure 5B:
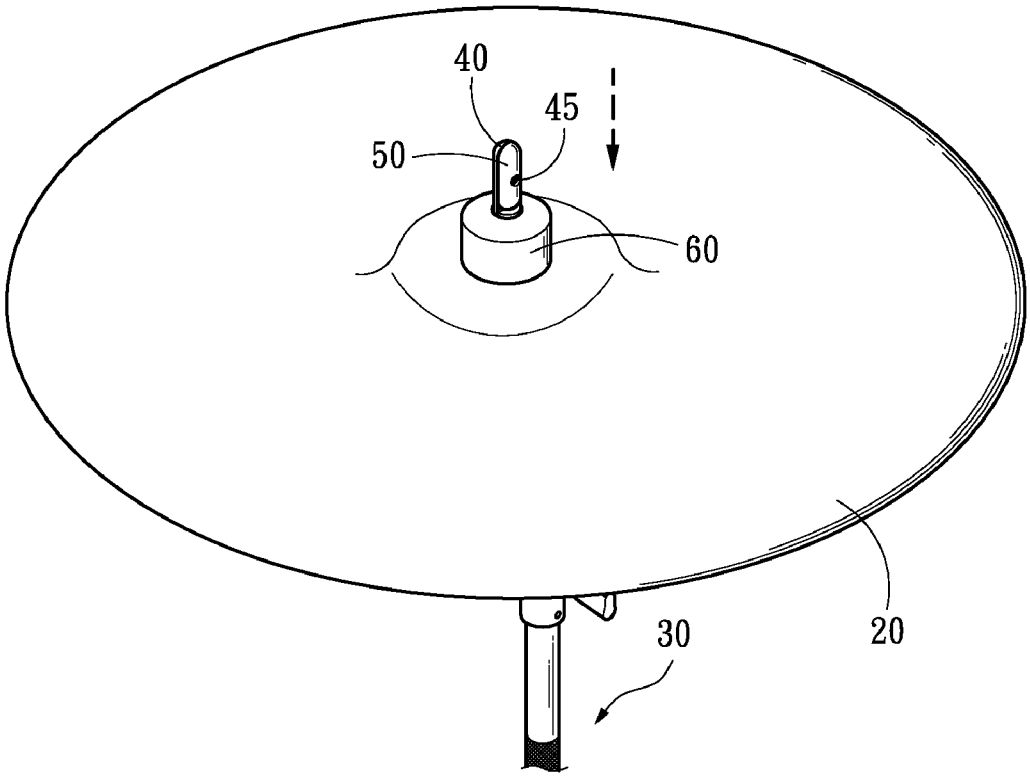
FIG. 5B is another schematic view showing a cymbal is assembled according to one embodiment of the present invention.
Figure 5C:
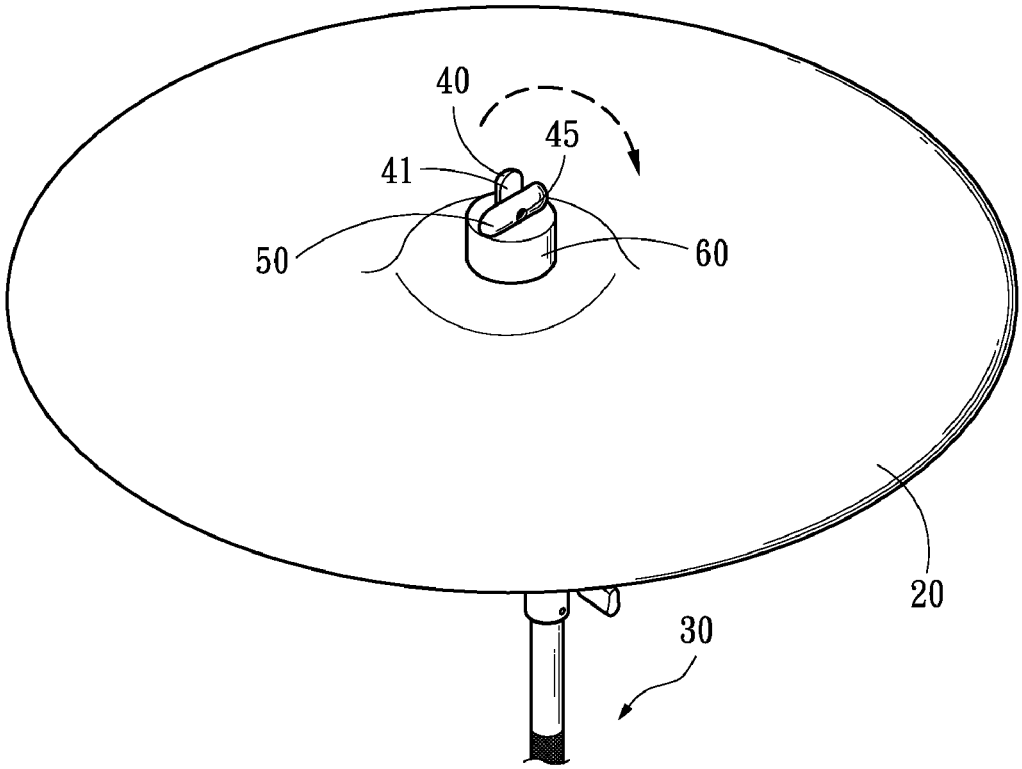
FIG. 5C is a yet another schematic view showing a cymbal is assembled according to one embodiment of the present invention.

Refer to FIGS. 5A-5C. In the present invention, the user can easily assemble or disassemble the cymbal 20 via rotating the rotary element 50. When the rotary element 50 is rotated to parallel the nut 40 (as shown in FIG. 5A), the upper felt 60 and the cymbal 20 can pass through the rotary element 50 and nut 40 to couple on the rod 30. Next, the user compresses the compression element 80 to reveal the rotary element 50 (as shown in FIG. 5B). Then, the rotary element 50 is rotated to not parallel the nut 40, the cymbal 20 is prevented from bouncing out (as shown in FIG. 5C). Thus, through the elastic force of the compression element 80 and the confinement of the rotary element 50, the cymbal 20 is clamped and secured.

In the present invention, through rotating the rotary element 50, the user can easily assemble or disassemble the cymbal 20, whereby the user can rapidly replace the cymbal 20. Further, through blocking the rotary element 50, the cymbal 20 can be effectively secured without being loosened during percussion, whereby the cymbal 20 can generate sounds with stable tone quality to meet user's requirements.

What is claimed is:

1. A cymbal support structure for holding a cymbal, comprising:

a rod;

a nut;

an upper felt;

a lower felt cooperating with the upper felt to clamp the cymbal;

a rotary element, wherein the rotary element and the nut are respectively formed in an elongate shape; the nut is fastened to on one end of the rod, and the rotary element is pivotally coupled to the nut; when the rotary element is rotated to parallel the nut, the cymbal, the upper felt and the lower felt pass through the nut and the rotary element to couple on the rod; when the rotary element is rotated to not parallel the nut, the cymbal, the upper felt and the lower felt are prevented from passing through the nut and the rotary element;

a compression element coupled on the rod; and an elevation adjustment ring screwed on the rod to push the compression element to compress the lower felt upwards.

2. The cymbal support structure according to claim 1 further comprising a plastic sleeve coupled on the rod and installed below the lower felt.

3. The cymbal support structure according to claim 1, wherein the rod includes threads, and the elevation adjustment ring is screwed on the threads; the nut being screwed on a distal end of the threads.

4. The cymbal support structure according to claim 1 further comprising a washer arranged between the compression element and the lower felt.

5. The cymbal support structure according to claim 1, wherein the compression element is a spring.

6. The cymbal support structure according to claim 1, wherein the elevation adjustment ring includes anti-slipping traces on the circumference thereof.

7. The cymbal support structure according to claim 1 further comprising a screw inserted into a middle portion of the rotary element and screwed on the nut.

8. The cymbal support structure according to claim 1, wherein the nut includes a notch where the rotary element is pivotally coupled to.

* * * * *